United States Patent [19]

Penick et al.

[11] 4,146,983

[45] Apr. 3, 1979

[54] PROMOTIONAL POP-UP AND METHOD OF MAKING

[75] Inventors: Ib Penick, Prospect Heights; John K. Volkert, Northfield, both of Ill.

[73] Assignee: Compak Systems, Inc., Northfield, Ill.

[21] Appl. No.: 746,340

[22] Filed: Dec. 1, 1976

Related U.S. Application Data

[63] Continuation-in-part of Ser. No. 638,558, Dec. 8, 1975, Pat. No. 3,995,388.

[51] Int. Cl.[2] ..... G09F 1/00

[52] U.S. Cl. ..... 40/124.1

[58] Field of Search ..... 46/34; 40/124.1, 126 B, 40/539

[56] References Cited

U.S. PATENT DOCUMENTS

| | | | |
|---|---|---|---|
| 1,854,225 | 4/1932 | Rosenthal | 46/34 X |
| 2,125,268 | 8/1938 | Boyer | 40/124.1 |
| 2,458,879 | 1/1949 | Schenk | 46/34 |
| 3,235,988 | 2/1966 | Paige | 46/34 X |

*Primary Examiner*—Louis G. Mancene
*Assistant Examiner*—Wenceslao J. Contreras
*Attorney, Agent, or Firm*—Fitch, Even, Tabin & Luedeka

[57] ABSTRACT

A pop-up item for promotional purposes wherein a cover panel and a back panel, hinged to each other along a straight line, sandwich a die-cut panel in which are formed a plurality of interconnected coupons and at least two tabs. One tab is joined to the cover, and the other tab means is joined to the back. Opening of the cover causes the coupons to pop-up and attract the attention of the recipient. The items can be inexpensively mass-produced as a part of a web-press or sheet-press operation.

12 Claims, 20 Drawing Figures

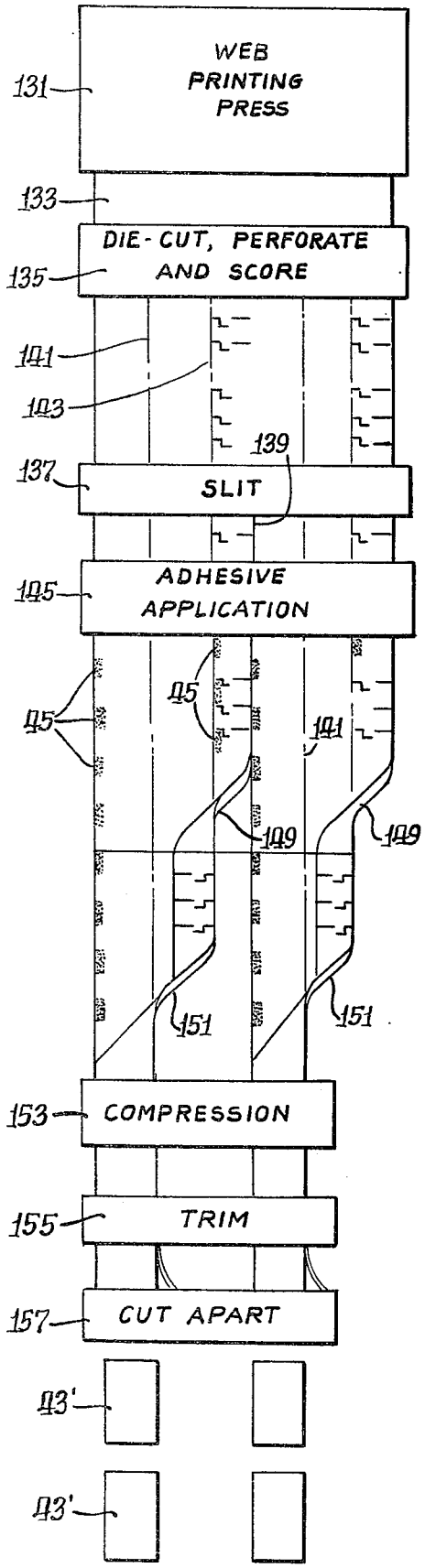
Fig. 11.
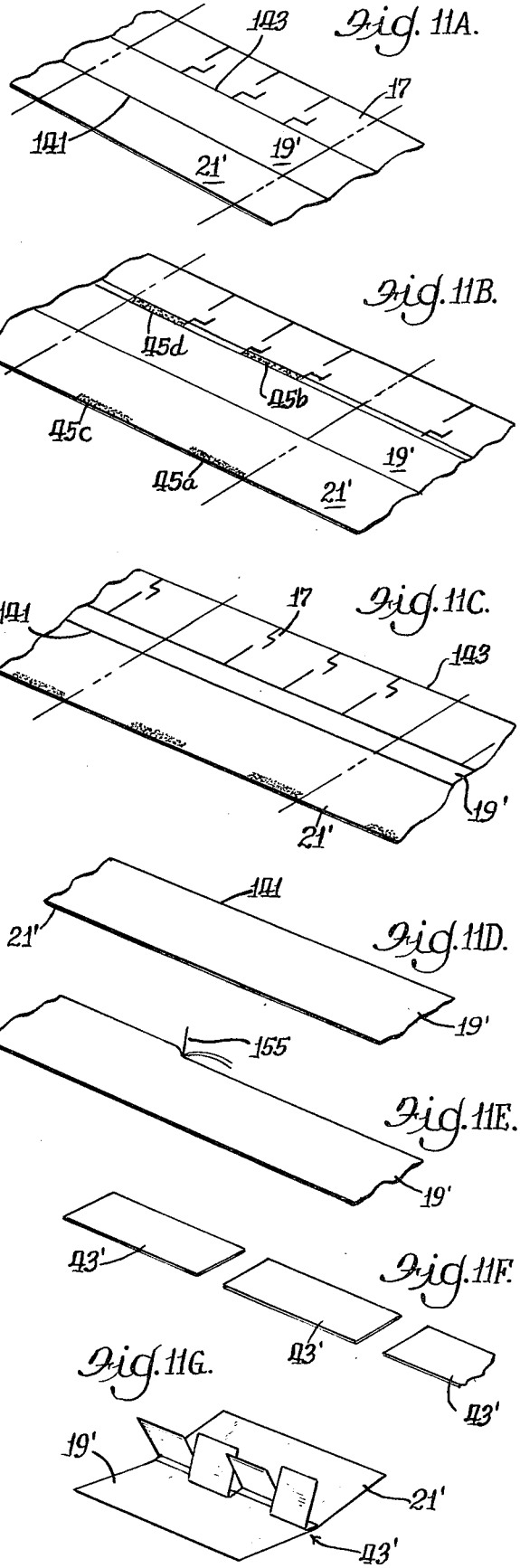
Fig. 11A.
Fig. 11B.
Fig. 11C.
Fig. 11D.
Fig. 11E.
Fig. 11F.
Fig. 11G.

PROMOTIONAL POP-UP AND METHOD OF MAKING

This application is a continuation-in-part of our earlier-filed application Ser. No. 638,558, filed Dec. 8, 1975, now U.S. Pat. No. 3,995,388, issued Dec. 7, 1976.

This invention relates to printed paper novelty devices of various types, and more particularly to dimensional and specialty paper products of this general character wherein a "pop-up" is provided. It is especially relevant to items which incorporate a plurality of coupons or like promotional pieces within a folder that, upon opening of the item, move upward and out of the plane of the remainder of the folder panels.

Advertising hand-outs, inserts, mailers and the like are being used with greater and greater frequency to distribute promotional pieces, such as cents-off coupons, two-for-one coupons, refund coupons, subscription coupons and the like. The value of such advertising and promotional materials, of course, lies in the attention which they can gain of the recipient, and commercially practical items of this type which have improved attention-getting features are always in demand.

It is an object of the present invention to provide improved designs for items of this character which are capable of fabrication by mechanical mass production and which have effective attention-getting features. A further object of the invention is to provide items of this character which embody a pop-up construction and can be produced by a series of automatically controlled mechanical steps that obviate the need for hand labor.

These and other objects of the invention will become apparent from the following detailed description of different constructions embodying features of the invention, particularly when read in conjunction with the accompanying drawings wherein:

FIG. 11 is a schematic view of a production line fabrication set-up illustrating one manner in which items like those of FIG. 2 may be made as a part of a web-press operation; and FIGS. 11A to 11G illustrate the web in the various stages shown in FIG. 11.

The inventional generally provides an item in the form of a folder wherein a plurality of coupons are sandwiched between a pair of hinged panels. The coupons are a part of a "pop-up" construction so that, when the hinged panels of the folder are opened, the coupon-bearing construction pops out of the plane of the hinged panels and immediately attracts the attention of the recipient. The methods for making these items ae particularly susceptible to being carried out on automatic die-cutting, gluing and folding machinery and thus render these items particularly attractive in the promotional and advertising fields where the ability to reach the mass market at reasonable prices is extremely important.

Figure 1:
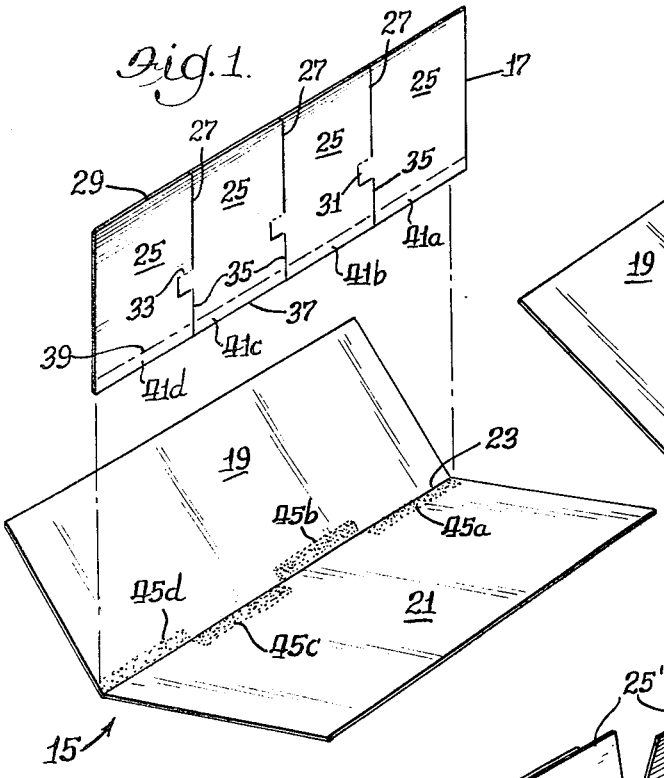
FIG. 1 is an exploded perspective view illustrating the fabrication of a coupon-bearing item embodying various features of the present invention.

FIG. 1 shows, in the exploded perspective view, an open folder 15, plus a center or insert panel 17. The folder 15 consists of a pair of base panels 19 and 21 which are hinged along a straight line 23. Although the term "folder" is generally used herethroughout, for purposes of convenience, to describe the ultimate items which functions by unfolding or opening two hinged base panels to which the pop-up structure is attached, the use of this term does not imply that a folding operation is necessary in the method of fabrication, although such is preferred. Reference is made, in this respect, to our earlier-mentioned U.S. patent which shows that the base panels may be formed from the same sheet as illustrated in FIG. 1 by folding that sheet upon itself, or that separate panels can be joined, adhesively or otherwise, along one edge to form a hinged construction, in which instance there is the option of sandwiching the center panel 17 between the base panels at the time of their joinder. Moreover, and particularly when the center panel 17 is formed from the same sheet as the base panels, there may be an advantage in hinging the base panels along a different edge and then trimming that edge after joinder along the ultimate hinge line is made as indicated above.

The central panel 17 is cut, generally by die-cutting, to provide four side-by-side coupons 25. Although the term "coupons" is used, for convenience, throughout the application, it should be understood that instead of being certificates redeemable in cash or in cents-off the purchase of certain merchandise or in a free gift upon purchase of certain merchandise, these "coupons" may be any other such promotional piece, for example, complementary tickets to an event or for a drawing, postpaid cards for a mail reply or promotional subscription offers. The coupons 25 are formed by parallel slits 27 which extend from what is termed the free edge 29 of the panel 17 to a point where an ear 31 is formed that extends laterally into the body of the adjacent coupon 25. The ears 31 are preferably located on the other side of the center of the panel from the free edge 29 to enhance the pop-up effect and are formed by die-cutting on two sides, leaving a short hinge line 33 along the edge of the ear closest to the free edge 29 of the panel. The hinge line 33 is transverse, perpendicular in the illustrated embodiment, to the slit 27 and is preferably formed as some defined line of weakness, for example, a score, a crease, a perforation, or the like. Additional slits 35, colinear with the slits 27, extend from the ears 31 to the opposite edge 37 of the panel, which is sometimes referred to as the rear or secured edge. Another defined line of weakness 39 is provided which is perpendicular to the rear slits 35 and which defines tabs 41 along the secured edge of the panel 17.

The coupons 25 may encompass the entire regions of the panel up to the tabs, in which case the lines of weakness 39 and the hinge lines 33 may be formed by perforating to facilitate detachment of the individual coupons. On the other hand, a transverse line of perforations (not shown) may be provided in the panel 17 parallel to the line of weakness 39, for example, in the region of the ears 31, so as to define coupons of lesser area and detachably connect them to the remainder of the body portion of the panel.

In fabricating a pop-up item 43, alternate tabs 41 are secured to the two base panels 19,21. For purposes of convenience in description, the base panel 19 is hereinafter spoken of as the cover panel, and the base panel 21 is referred to as the back panel. The folder 15 and center panel 17 are formed from any suitable sheet material, for example, card-stock fiberboard, and they may be made from the same or different materials.

The tabs 41 are appropriately secured in surface contact with the interior surfaces of either the cover panel or the back panel—preferably by adhesive although other suitable methods of joinder, e.g., stapling, stitching, etc., can be used. Any suitable adhesive can be used, and the adhesive may be applied at any appropriate time and to the surfaces of the base panels 19,21, or to the surface of the tabs 41, or to both. For example, a solvent-based or a hot-melt adhesive having substantial tackiness may be used, and in such an instance the fabrication of the item 43 will have been completed when the center panel 17 has been sandwiched between the base panels of the folder 15 and the adhesive has set. On the other hand, a heat-activated or ultrasonic-activated adhesive may be applied to the appropriate surfaces at any time during the fabrication and allowed to dry before the association of the center panel 17 with the folder 15. In such a case, the adhesive bond would thereafter be achieved by exposing the folded assembly to compression plus heat or ultrasonic energy. It is also possible to apply or print a water-activated adhesive upon the appropriate surfaces and then subsequently activate the adhesive by appropriate application of moisture; however, the use of other adhesives is preferred.

In the illustrated version, adhesive patterns **45*a* and 45*c*, corresponding to the location of the tabs 41*a* and 41*c* on the insert 17, are applied to the back panel 21, and adhesive patterns 45*b* and 45*d*, corresponding to tabs 41*b* and 41*d* are applied to the cover panel 19 adjacent the central fold line 23. The insert 17 is then placed with its rear edge 37 against the hinge line 23, the cover and back panels are closed, and suitable compression is applied while the adhesive sets. As a result, the visible surface of tabs 41*a* and 41*c* (as viewed in FIG. 1) is adhesively connected in surface contact with the interior surface of the rear panel 21, and the hidden or opposite surface of the tabs 41*b* and is adhesively joined to the interior surface of the cover panel 19**.

Figure 2:
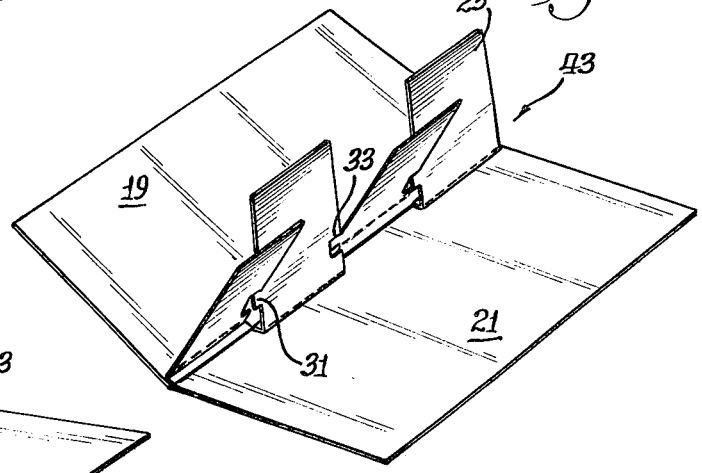
FIG. 2 is a perspective view of the completed item of FIG. 1 shown in its open position.

When the folder 15 is opened by the recipient so as to pivot one of the base panels about the hinge line 23 relative to the other, the adhesive bonds between the tabs 41 and the base panels cause the structure of the insert panel 17 to pop-up from the planes of both base panels and assume the configuration shown in FIG. 2. The pop-up construction is an excellent attention-getter from the standpoint that the coupons 25 alternately extend in different directions, disposed in planes which lie at a substantial angle to each other, thus presenting an eye-catching and attractive configuration. As earlier indicated, the lines along which the coupons 25 are attached to the remainder of the panel 17 are preferably defined lines of weakness, e.g., perforations, so as to facilitate easy detachment by the recipient of one or more coupons from the remainder of the panel.

Figure 3:
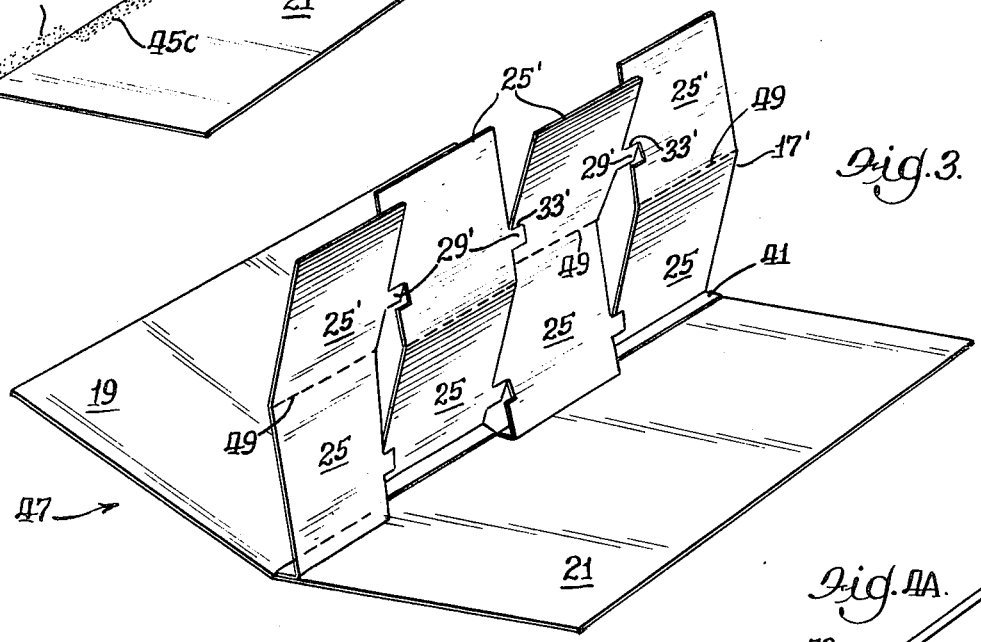
FIGS. 3 and 4 are perspective views, generally similar to FIG. 2, of alternative versions of items embodying various featues of the invention.

Depicted in FIG. 3 is an item 47, which is an alternative version of the item 43 shown in FIGS. 1 and 2, wherein an insert or center panel 17' is employed which is wider than the insert 17, being about the width of the base panels 19,21. The center panel 17' contains a second set of coupons 25' which are appended via perforations 49 to the free ends of the coupons 25. The coupons 25' are likewise formed with ears 29' so that they are hinged together along the lines 33' in the same manner as are the coupons 25. The fabrication of the item 47 is otherwise substantially the same as the item 43, and upon opening, the die-cut panel 17' takes the eye-catching configuration shown in FIG. 3. This alternative embodiment provides double the number of coupons 25 as the embodiment shown in FIGS. 1 and 2.

Figure 4:
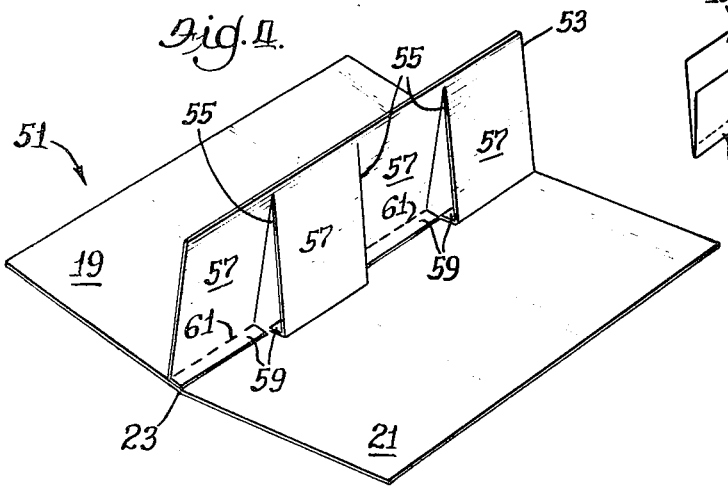

Illustrated in FIG. 4 is still another generally similar version of an item 51 which includes a pair of base panels 19,21 connected along a hinge line 23 wherein a center or insert panel 53 is die-cut to provide three slits 55 that define four coupons 51. The slits 55 extend for substantially the entire width of the center panel 53, terminating just short of the free edge so as to leave the coupons 57 interconnected to each other at this location. A tab 59 is formed at the opposite end of each coupon 57 along a defined line of weakness 61, which may be a line of perforations to facilitate easy removal of the individual coupons.

As in the case of the items 43 and 47 shown in FIGS. 2 and 3, alternate tabs 59 are adhesively connected to the cover panel 19 and to the back panel 21, respectively. As a result, when the base panels 19,21 are opened to spread adjacent tabs 59 apart from each other, the individual coupons 57 stand up and attract attention, with alternate coupons disposed in planes which lie at a substantial angle to each other and which planes intersect at about the free edge where the coupons are interconnected. The coupons 57 can be readily individually detached by tearing along the perforations 61 and across the short distance of the interconnections adjacent the free edge.

Figure 4A:
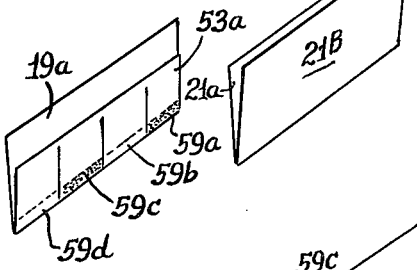
FIGS. 4A and 4B show two methods for making an item similar to that shown in FIG. 4.
Figure 4B:
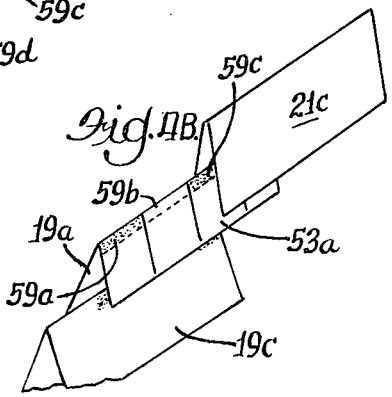

Illustrated in FIGS. 4A and 4B are two alternative methods for creating a pop-up item generally similar to that shown in FIG. 4. In FIG. 4A, a die-cut folded sheet is employed which provides both a base panel **19*a*, which serves the function of the cover panel, plus a hinged panel 53*a* which serves as the center panel. The panel 53*a* is die-cut in the same manner as the panel 53 to provide four coupons with associated tabs 59**.

Prior to the stage of fabrication illustrated in FIG. 4A, adhesive has been applied in the region of the tabs **59*b* and 59*d* so as to effect joinder of these two tabs to the adjacent hinged surface of the base panel 19*a*. Thereafter, an adhesive pattern is applied to the tabs 59*a*, and 59*c*, as illustrated, which thereafter effects joinder of these tabs to the surface of a base panel 21*a* which is part of a folded sheet that also includes panel 21*b*. The assembly process illustrated in FIG. 4A** is exemplary of one which might be performed during the collation and/or assembly of a book or magazine of the type that is perfect bound, i.e., wherein groups or signatures of folded pages are collated and then adhesively connected along a backbone within a cover. Accordingly, the ultimate pop-up item is being manufactured during the manufacturinfg and final assembly of the book or magazine.

FIG. 4B illustrates another way of assembling such a pop-up item where a so-called saddle-binding process is used to make the book or magazine or pamphlet wherein the item will be distributed. In this arrangement, a similar die-cut structure is employed wherein the panel 53*a* is hinged to another sheet 19*a;* however, in the FIG. 4B embodiment, the adhesive joinder of the tabs 59 is not made to the surface of hinged sheet 19*a,* but it is instead made to a pair of sheets 19*c* and 21*c,* both of which are halves of folded "four-page" units in the illustrative assembly process depicted in FIG. 4B.

An appropriate glue pattern is applied to the panel 19*c* at the locations indicated which correspond to the tabs 59*b* and 59*d,* and an adhesive pattern is applied directly to the tabs 59*a* and 59*c.* Thereafter, assembly of the three units in the manner shown with the center panel 53*a* sandwiched between the panels 19*c* and 21*c,* as a part of the saddle binding process, effects the appropriate adhesive joinder. Thereafter, when the recipient spreads the panels 19*c* and 21*c* apart the die-cut panel 53*a* assumes the configuration of the panel 53 depicted in FIG. 4.

This concept of fabricating the pop-up item as a part of the final binding or assembly of the magazine, pamphlet or the like is not limited to an arrangement where the die-cut center panel is a part of a folded sheet. The separate panel 17 shown in FIG. 1 or the panel 53 shown in FIG. 4 may also be employed in this manner. For example, the center panel 17 may be appropriately adhesively joined to the outer surface of one signature, and then this subassembly appropriately adhesively joined to another signature during the binding operation. In such instance, the pop-up item is thus formed by the center panel 17 plus the other surfaces of sheets from two different signatures.

Figure 5:
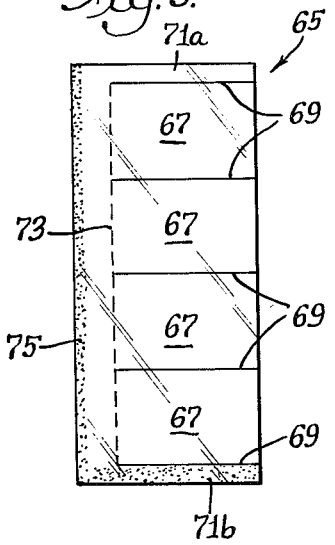
FIG. 5 is a plan view of a die-cut panel.
Figure 6:
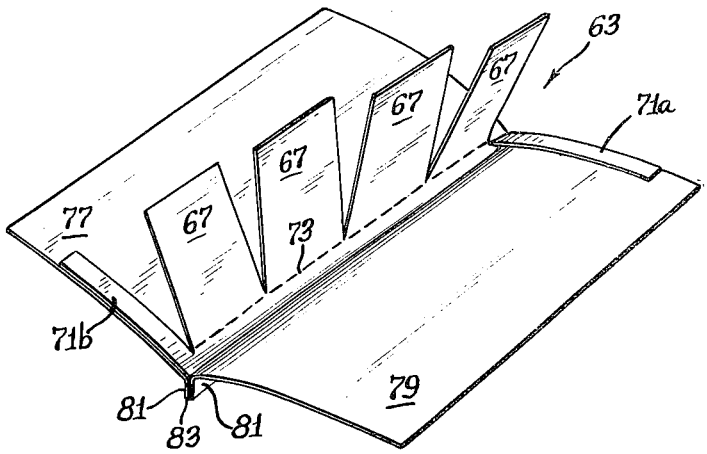
FIG. 6 is a perspective view of all items incorporating the panel of FIG. 5 and embodying certain features of the invention.

Illustrated in FIGS. 5 and 6 is a further embodiment of an item 63 wherein a coupon-carrying center or insert panel 65 is employed which is die-cut or otherwise slit to form four side-by-side coupons 67 that are defined by five parallel slits 69. The upper and lowermost slits 69 also define a pair of tabs 71*a* and 71*b.* The slits 69 extend from the right-hand or free edge of the panel 65 (as viewed in FIG. 5) to a line of perforations 73 by which the coupons 67 are detachably connected to the remainder of the body portion of the panel 65. The panel 65 is made slightly wider than it would be were it to be inserted between a pair of base panels folded from the same sheet along a hinge line, such as illustrated with respect to FIG. 1, and the extra width provides an extension 75 along the left-hand edge.

As shown in FIG. 6, separate base panels 77 and 79 are used which may each be provided with a line of weakness, preferably a score line or crease, generally adjacent and parallel to one edge to create a flange or extension 81. In fabricating the item 63, an adhesive pattern is provided, for example, along the upper surface of the extension portion 75 of the center panel 65 and along the upper surface of the lower tab 71*b.* An adhesive pattern is also appropriately provided along the interior surface of the flange portion 75 of the back panel 79 and in the region corresponding to the location of the upper tab 71*a* or altenatively along these regions of the undersurface of the center panel. Assembly of the three pieces with center panel 65 sandwiched between the cover panel 77 and the back panel 79 creates a three-member rib 83 which hinges the base panels together and also effects joinder of the lower tab 71*b* to the cover and the upper tab 71*a* to the back panel. Instead of creating the rib 83 by gluing, it could be created by stapling, stitching or the like. When the item 63 is opened by spreading the cover and back, the coupons 67 pop-up from the base panels, fanning out into the positions illustrated in FIG. 6. The individual coupons 67 lie in planes which are disposed at substantial angles to one another and provide an attention-getting appearance.

Figure 8:
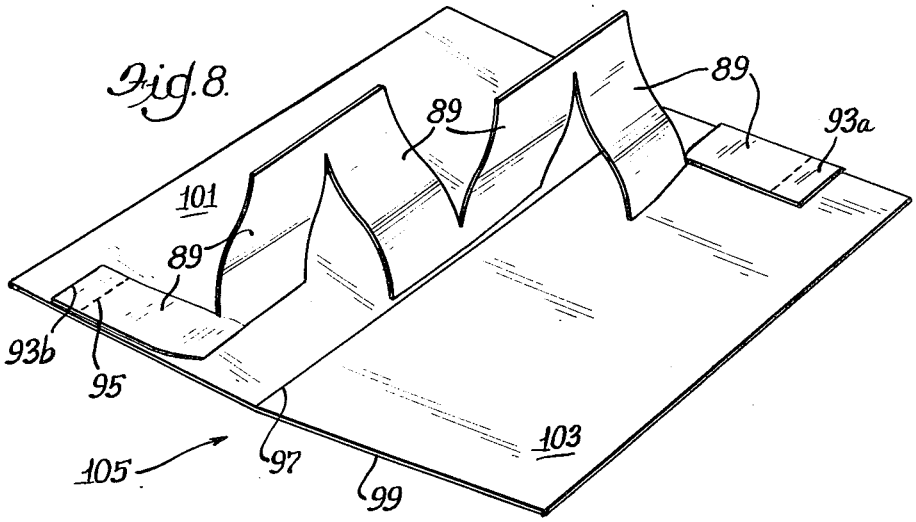
FIGS. 7 and 8 are views similar to FIGS. 5 and 6, respectively, of still another item embodying various features of the invention.
Figure 7:
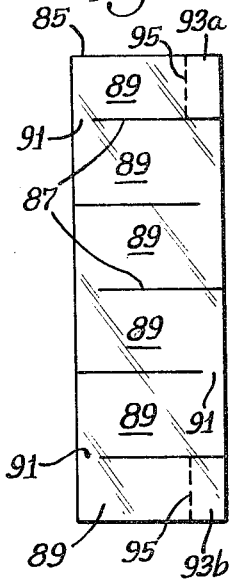

Illustrated in FIGS. 7 and 8 is an embodiment wherein a central panel 85 is employed which is die-cut or otherwise slit to provide slits 87 which extend from alternate edges of the panel and define a number of side-by-side coupons 89. The slits 87 alternately terminate a substantial distance short of first one and then the other lateral edge of the panel 85 to leave a short interconnection 91 which links adjacent coupons 89 to each other. These interconnections 91 may be weakened, as by scoring or perforating, to facilitate the separation of one or more individual coupons from the remainder of the panel 85. If desired to facilitate handling, the slits 87 may also be terminated just short of the edge at which they originate to leave weak points of attachment at these locations which facilitate handling during fabrication but are easily torn upon first opening of the fabricated item. Short tabs 92*a* and 93*b* are created at the two ends of the strip of interconnected coupons 89, preferably being formed by defined lines of weakness 95, e.g., perforations; thus, these tabs 93 are carved out of the uppermost and lowermost coupons 89. Although such perforations 95 facilitate the eventual detachment of these two coupons, these lines of weakness could be omitted without necessitating any deviation from the adhesive attachment which is described hereinafter.

Instead of locating the center panel 85 with its left-hand edge (FIG. 7) in juxtaposition to a fold line 97 of the folder 99, it is preferably located generally centrally of the base panels 101,103 of the folder to give greater effect to this particular design. The undersurface of the uppermost tab 93*a* is adhesively joined to interior surface of the back panel 103, and the upper surface of the lower tab 93 is joined to the interior surface of the cover panel 103 to produce a promotional item 105. When the item 105 is opened by spreading the cover and back panels 101,103 apart, the adhesive joinder at the tabs 93 has the effect of stretching the die-cut panel 85, which results in the prompt rupture of any weak points that were allowed to remain where the slits 87 originate. As a result, the die-cut center panel 85 pops-up from the base panels and takes the zig-zag configuration depicted in FIG. 8, where adjacent coupons 89 are oriented at substantial angles to each other and which creates an attention-getting effect.

Figure 10:
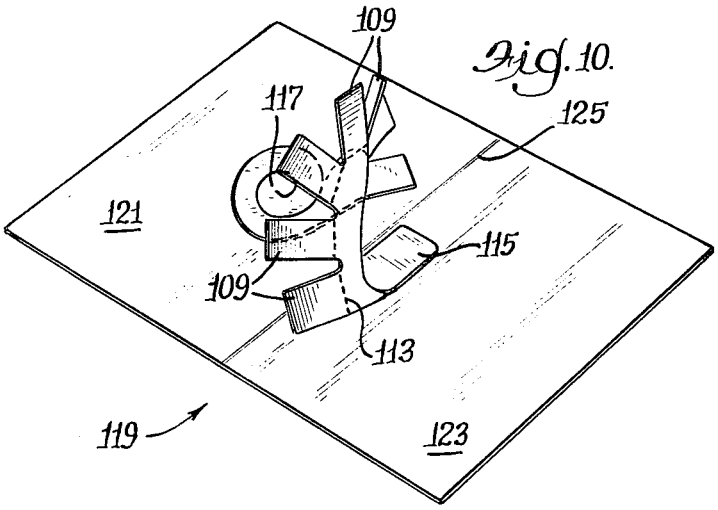
FIGS. 9 and 10 are views similar to FIGS. 5 and 6, respectively, of yet another item embodying various features of the invention.
Figure 9:
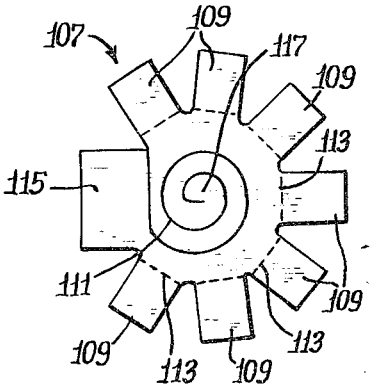

Illustrated in FIGS. 9 and 10 is still another embodiment of the invention wherein a center panel 107 is die-cut to provide seven coupons 109 which are disposed generally radially and spaced regularly about the periphery of a center portion. The center portion contains a spiral die-cut slit or cut 111 which extends from the periphery to a point of termination which is generally in the center region of the panel 107. The coupons 109 are preferably connected by defined lines of weakness 113, e.g., perforations, that facilitate their eventual detachment from the remainder of the panel which interconnets all of the coupons with one another. The design of the die-cut panel 107 is such that a large tab 115 is provided at the outer end of the spiral, and a somewhat smaller tab 117 is provided near the inner end of the spiral body portion, both of which are created by the spiral cut 111.

FIG. 10 illustrates an item 119 that is formed by combining the center panel 107 with base panels 121 and 123 of a folder that is formed with a central hinge line 125. In the fabrication of the item 119, a suitable adhesive pattern is applied either to the undersurface of the large outer tab 115, or to the corresponding region of the interior surface of the back panel 123 or to both, and another adhesive pattern is similarly used to join the upper surface of the interior tab 117 to the interior surface of the cover panel 121. The die-cut panel 107 is aligned with and sandwiched between the cover 121 and back panel, and compression is employed until the adhesive sets.

When the folder is opened so that the item 119 takes the disposition depicted in FIG. 10, the die-cut center panel 107 is spread apart by the movement of the tabs 115,117 away from each other, causing it to pop-up out of the plane of the base panels. As a result, the coupons 109 are presented in an undulating row, with each of them lying in a plane disposed at a considerable angle to the adjacent coupon. The result is an attractive and attention-getting structure wherein the major portions of the base panels 121,123 are available for illustration and promotional text relating to the subject matter of the coupons 109. Each coupon 109 is individually easily detachable along the line of perforations 113 by which it is interconnected to the spiral body portion of the remainder of the panel 107.

Shown in FIG. 11 is a diagrammatic view of an illustrative arrangement of one particularly efficient way of producing coupon-carrying, pop-up items essentially the same as the item 43 shown in FIGS. 1 and 2, as a part of an in-line web printing press arrangement which is capable of high-speed mass production operation. A web printing press 131 is diagrammatically indicated which is capable of printing both surfaces of a web of fiberboard material, such as card stock or magazine-weight paper, preferably in several colors. The printed web 133 is delivered first to a station 135 where it is die-cut, perforated and scored as desired to produce a pattern in the center panel 17 as shown in FIG. 1. It is contemplated that the usual web press would be a web of a width sufficient to accommodate at least two printed layouts side-by-side, as shown exiting from the station 135.

The web 133 next enters a slitter 137 where it is cut centrally along a line 139 to separate it into a pair of ribbons. Each ribbon has the appearance shown in FIG. 11A including a pair of parallel score lines or crease lines 141, 143. These score lines are considered optional, but they aid in achieving the precise folding of the panel 17 and the cover panel 19' relative to the back panel 21'. FIG. 11A also includes dot-dash lines which would not appear in the web itself but which are included for purposes of illustration to demarcate adjacent items. The slit web then goes to an adhesive applicator 145 where adhesive patterns 45 are applied to the center panel 17 and to the back panel 21' as best illustrated in FIG. 11B.

Immediately following adhesive application, the slit web is conveyed to plows 149 and 151 wherein the slit ribbons are folded upon themselves. The plows 149 fold the center panels 17 over onto the cover panel 19' along the line of weakness 143 so that each of the ribbons then has the configuration as shown in FIG. 11C. In this configuration, the adhesive pattern **45*b* and 45*d*, which were placed on two of the tabs of the center panel 17, are beginning to bond these tabs to the cover 19'**.

Next, the plows 151 fold the once-folded ribbon along the line of weakness 141 to dispose the panels 17 and 19' atop the panel 21' with the panel 17 sandwiched between the panels 19' and 21', as shown in FIG. 11D. Alternatively, the plows 151 could be located on the opposite side of the ribbon so as to fold the panel 21' region over onto the center panel 17. In this orientation, the adhesive patterns **45*a* and 45*c* which were applied to the edge of the back panel 21' are now in contact with the opposite surfaces of the remaining two tabs of the insert or center panel 17**, and joinder is beginning.

The completely folded ribbons are then fed through a compression station 153 which assists in obtaining a good adhesive bond between the tabs and the interior surfaces of the cover and back panels 19',21'. Next, the ribbons are fed through a trimmer 155, as depicted in FIG. 11E, wherein the right-hand edge of the folded assembly is removed. This trimming separates the free edges of the cover panel 19' and the back panel 21', which were earlier joined along the fold line 141. Finally, the trimmed ribbons are cut, as by a rotary cutter 157, to form the individual items 43', as depicted in FIG. 11F.

Once the adhesive sets so that the bond is firm, opening of the cover panel 19' and the back panel 21' results in the attractive configuration shown in FIG. 11G, which is essentially similar to that shown in FIG. 2. The only difference is that, in the FIG. 11G configuration, the cover panel 19' is not hinged directly to the back panel 21', as the panels 19 and 21 were along the fold line 23; instead, the panels 19' and 21' are indirectly hinged together via the adhesive bonds of the back panel 21' to the tabs **41*a* and 41*c* which tabs are connected to the front panel 19' along the fold line 143** of the web.

Clearly, many of the steps of the method illustrated in FIG. 11 can be performed in a different sequence; for example, the trimming of the folded and glued ribbon can be effected after it has been cut apart into the individual items. Alternatively, the slitting of the web 133 into two ribbons can take place after the adhesive application, or the adhesive can be applied as a part of the printing operation and then suitably activated as a part of the compression step or even subsequently. Moreover, instead of using two folding operations, it is possible to further slit the web so that, for example, the center panels 17 comprise a separate ribbon of fibrous material which ribbon is then suitably displaced onto one of the base panels before the folding step; for example, in the general manner depicted in FIG. 1. Still furthermore, the illustrated web 133 could be slit into six ribbons so that the base panels and the center panel are all separate ribbons, in which case lateral displacement of the ribbons is made to create the three-member sandwich.

Moreover, depending upon the design of the item desired, only the base panels may be cut from the continuous web, and the center panel might be separately made from sheet material, perhaps of a different weight stock. In this case, the separate die-cut center panels can be individually tipped onto the continuous web, using conventional machinery which is available for this purpose, for example, the Ad-A-Card unit which is manufactured in York, Pa. Likewise, mass production manufacture of these items is not limited to a web press operation, but it can also be performed using conventional sheet presses and appropriate conveying of the items to different stations for the cutting, folding and adhesive application operations. Accordingly, although the invention has been illustrated with respect to a number of preferred embodiments, such modifications and changes as would be obvious to those having the ordinary skill in the art, including those modifications which have been referred to hereinabove, should be understood as coming within the scope of the invention which is defined solely by the appended claims.

Various of the features of the invention are set forth in the claims which follow.

What is claimed is:

1. An item of the character described which comprises a pair of base panels of sheet material which are hinged to each other along a straight line and a coupon-carrying panel including a plurality of side-by-side coupons which are generally defined by slit means therebetween, said coupon-carrying panel having tab means formed therein corresponding in number to the number of said coupons, and said coupon-carrying panel being disposed between said base panels and each tab means being joined in surface contact to an opposite base panel from that to which the adjacent tab means is joined, whereby opening of said item causes said plurality of coupons to stand up from the respective planes of said base panels with adjacent coupons disposed in substantially different planes.

2. An item in accordance with claim 1 wherein said slit means extends from one edge of said coupon-carrying panel to a location on the other side of the center of said panel at which location adjacent coupons are hinged together.

3. An item in accordance with claim 1 wherein adjacent coupons are hingedly attached to each other by an ear which extends laterally from one coupon and which is connected to the adjacent coupon along a line transverse to said slit means.

4. An item in accordance with claim 2 wherein said coupons are joined to each other at their ends opposite from said tab means and wherein said slit means separates adjacent tab means from each other in addition to defining said coupons.

5. A die-cut coupon-carrying panel made of sheet material for forming an item of the character described which, when opened, contains a plurality of coupons that stand up out of the planes of the remainder of the item with adjacent coupons disposed in substantially different planes, said panel comprising a plurality of side-by-side coupons which are defined by generally parallel slit means extending from one edge of said coupon-carrying panel to a location on the other side of the center of said panel, at which location adjacent coupons are hinged together, adjacent coupons being hingedly attached to each other by an ear which extends laterally from one coupon and which is connected to the adjacent coupon along a line transverse to said slit means, and tab means formed in said panel adjacent the opposite edge to said one edge corresponding in number to the number of said coupons, said coupon-carrying panel being adapted to be sandwiched between a pair of base panels with each tab means joined in surface contact to a different base panel from that to which the adjacent tab means is joined, in which sandwiched configuration the base panels are hinged to each other along said opposite edge.

6. An item of the character described which comprises a pair of base panels of sheet material which are hinged to each other along a straight line and a die-cut panel including a plurality of coupons which are interconnected to one another, said die-cut panel having at least two tab means formed therein and said coupon-carrying panel being disposed between said base panels with one of said tab means being joined in surface contact to one base panel and with said other tab means being joined in surface contact to said other base panel, whereby opening of said item causes said plurality of coupons to stand up from the respective planes of said base panels.

7. An item in accordance with claim 6 wherein said coupons are defined by slit means which extend inward from an edge of said die-cut panel.

8. An item in accordance with claim 7 wherein said die-cut panel is generally rectangular, and wherein said tab means are located adjacent opposite edges of said die-cut panel.

9. An item in accordance with claim 8 wherein all said slit means extend from the same one of the remaining two edges of said die-cut panel.

10. An item in accordance with claim 8 wherein said slit means alternately extend from opposite edges of the remaining two edges of said die-cut panel.

11. An item in accordance with claim 6 wherein said die-cut panel includes a generally spiral body portion, wherein said coupons extend generally radially outward from the periphery of said spiral portion, wherein one said tab means is located at the center of said spiral and said other tab means is located adjacent the outer end of said spiral.

12. An item in accordance with claim 6 wherein each of said coupons is detachably connected to the remainder of said die-cut panel along a defined line of weakness.

* * * * *

UNITED STATES PATENT AND TRADEMARK OFFICE

CERTIFICATE OF CORRECTION

PATENT NO. : 4,146,983

DATED : April 3, 1979

INVENTOR(S) : Ib Penick and John K. Volkert

It is certified that error appears in the above-identified patent and that said Letters Patent are hereby corrected as shown below:

Column 1, line 64, "inventional" should read --invention--.

Column 2, line 3, "ae" should read --are--,

Column 2, line 15, "purposes" should read --purpose--,

Column 2, line 15, "items" should read --item--.

Column 4, line 64, "manufacturinfg" should read --manufacturing--.

Column 5, line 31, "other" should read --outer--.

Column 6, line 22, "92a" should read --93a--.

Column 7, line 64, "pattern" should read --patterns--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*